US006171123B1

(12) United States Patent
Chang

(10) Patent No.: US 6,171,123 B1
(45) Date of Patent: Jan. 9, 2001

(54) ELECTRICAL CONNECTOR

(75) Inventor: Yao-Hao Chang, Chung-Ho (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/192,832

(22) Filed: Nov. 16, 1998

(30) Foreign Application Priority Data

Nov. 17, 1997 (TW) ..... 86219327

(51) Int. Cl.[7] ..... H01R 29/00
(52) U.S. Cl. ..... 439/188; 439/81
(58) Field of Search ..... 439/188, 944, 439/81, 66, 862; 200/51.1, 51.09, 51.05

(56) References Cited

U.S. PATENT DOCUMENTS 5,133,676 * 7/1992 Hutchison et al. ..... 439/581
5,233,501 * 8/1993 Allen et al. ..... 361/733
5,264,672 * 11/1993 Ishii et al. ..... 200/275
5,278,570 * 1/1994 Jaramillo et al. ..... 343/702
5,625,177 * 4/1997 Yukinori et al. ..... 200/1 R

* cited by examiner

*Primary Examiner*—Michael L. Gellner
*Assistant Examiner*—Kyung S. Lee

(57) ABSTRACT

An electrical connector in a portable telecommunication device with a built-in antenna to enable the device to connect with an external antenna, comprises a dielectric housing having a base portion defining first and second chambers communicating with each other via a passage, and a cylindrical portion defining a hole therethrough in communication with the first chamber, a first contact fixedly received in the first chamber and electrically connecting with speaker/receiver circuitry of the device and a second contact fixedly received in the second chamber and electrically connecting with the built-in antenna. When the connector does not connect with a mating connector in electrical connection with an external antenna, the first contact electrically engages with the second contact by a spring force generated from the first contact. When the connector is connected with a mating connector in connection with an external antenna by extending a conductive pin of the mating connector through the hole in the cylindrical portion into the first chamber, the pin engages with the first contact and prevents it from engagement with the second contact.

9 Claims, 3 Drawing Sheets

ELECTRICAL CONNECTOR

BACKGROUND OF THE INVENTION

1. Field of the Invention

The present invention relates to an electrical connector, and particularly to an electrical connector for use in a portable wireless telecommunication device to enable the device to exchangably connect with different external antennae.

2. The Prior Art

Following the development of communication technology, portable wireless telecommunication devices are becoming increasingly popular. To meet different operating circumstances, the device needs to be exchangably connected with different antennae. To achieve this, a connector which can exchangably connect with coaxial connectors in electrical connection with different antennae is mounted in the device. U.S. Pat. No. 5,278,570 discloses such a connector. However, this prior art connector has a relatively complicated structure resulting in a high cost.

Hence, an improved connector is needed to eliminate the above mentioned defects of current connectors.

SUMMARY OF THE INVENTION

Accordingly, an objective of the present invention is to provide an electrical connector for a portable telecommunication device which enables the device to connect with an external antenna, wherein the connector has a simple structure and a low cost.

To fulfill the above mentioned objective, according to the preferred embodiment of the present invention an electrical connector for use in a portable wireless telecommunication device having a built-in antenna to enable the device to connect with an external antenna, includes a dielectric housing, a metallic shielding, and first and second conductive contacts. The housing has a rectangular base portion defining a first chamber exposed to a first lateral side thereof and a second chamber exposed to a second lateral side thereof and communicating with the first chamber via a passage, and a cylindrical upper portion projecting from a middle of the base portion and defining a hole in communication with the first chamber. The first contact is fixedly received in the first chamber with a contact portion located just below the hole and a tail portion extending along a bottom of the base portion of the housing toward the first lateral side thereof for being soldered to a PCB to electrically connect with receiver/speaker circuitry of the telecommunication device. The second contact is fixedly received in the second chamber with a contact portion extending through the passage to electrically engage with the contact portion of the first contact by a spring force of the first contact when the connector is not engaged with a mating connector, and a tail portion extending along the bottom of the base portion of the housing for being soldered to the PCB to electrically connect with the built-in antenna. When a mating connector connecting with an external antenna connects with the connector, a conductive pin thereof extends through the hole of the upper portion of the housing into the first chamber to engage with the contact portion of the first contact thereby preventing engagement with the second contact. A metallic shielding encloses the upper portion and front and rear sides of the base portion of the housing. The shielding has two grounding tabs extending beyond the bottom of the base portion of the housing.

DETAILED DESCRIPTION OF THE PREFERRED EMBODIMENT

Reference will now be made in detail to the preferred embodiment of the present invention.

Figure 1:
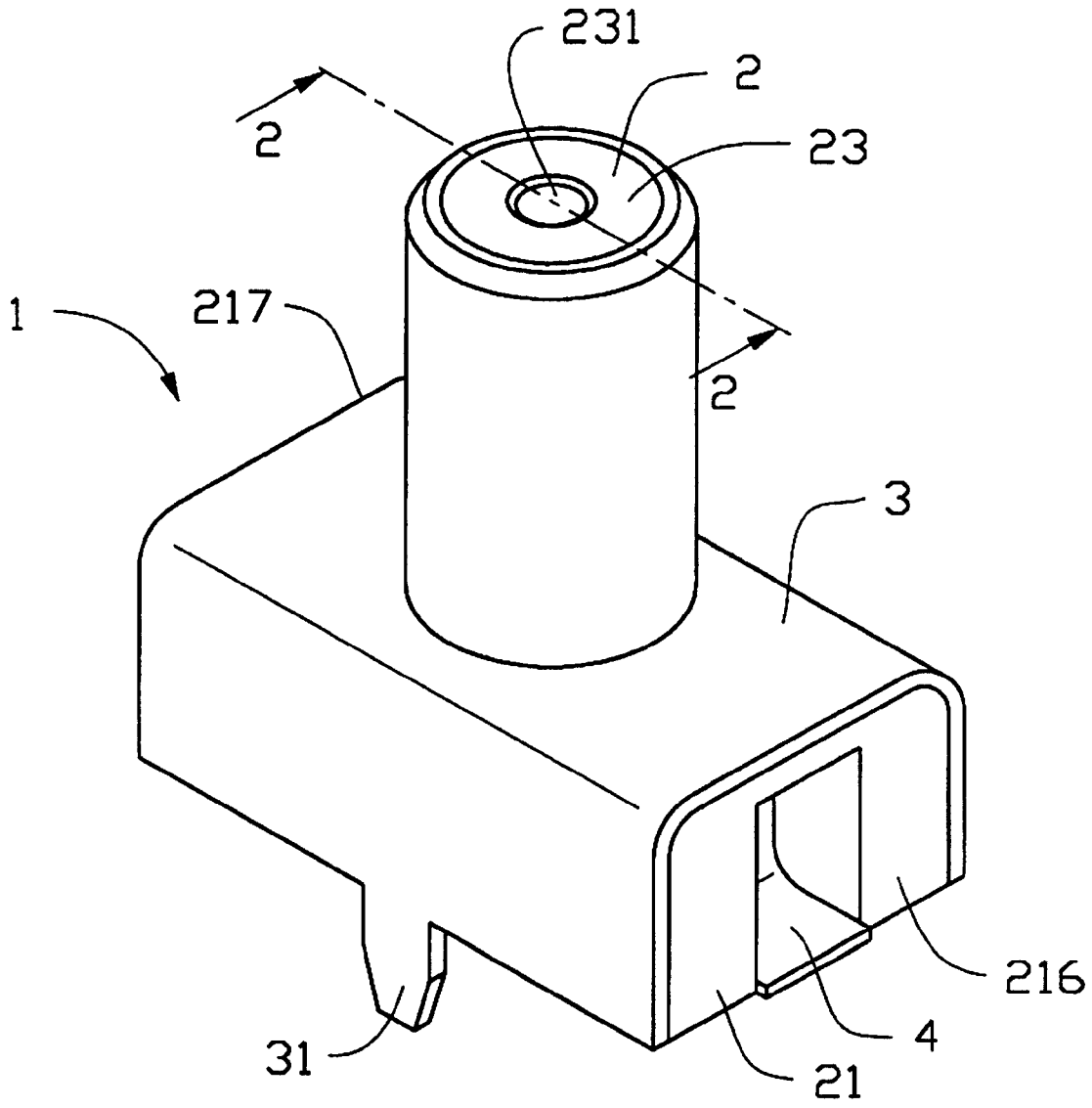
FIG. 1 is a perspective view of an electrical connector in accordance with the present invention.
Figure 2:
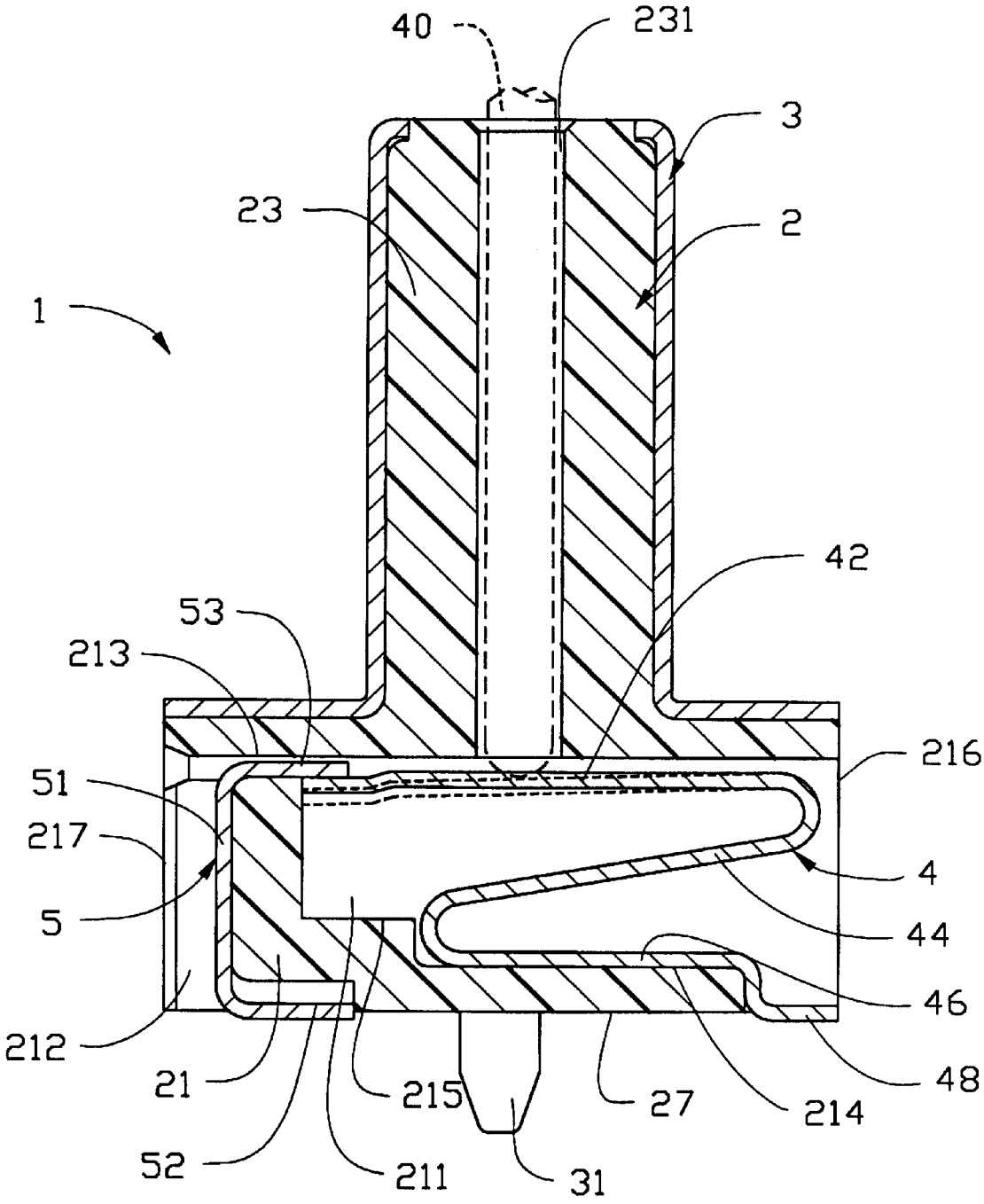
FIG. 2 is an cross-sectional view taken along line 2—2 of FIG. 1.
Figure 3:
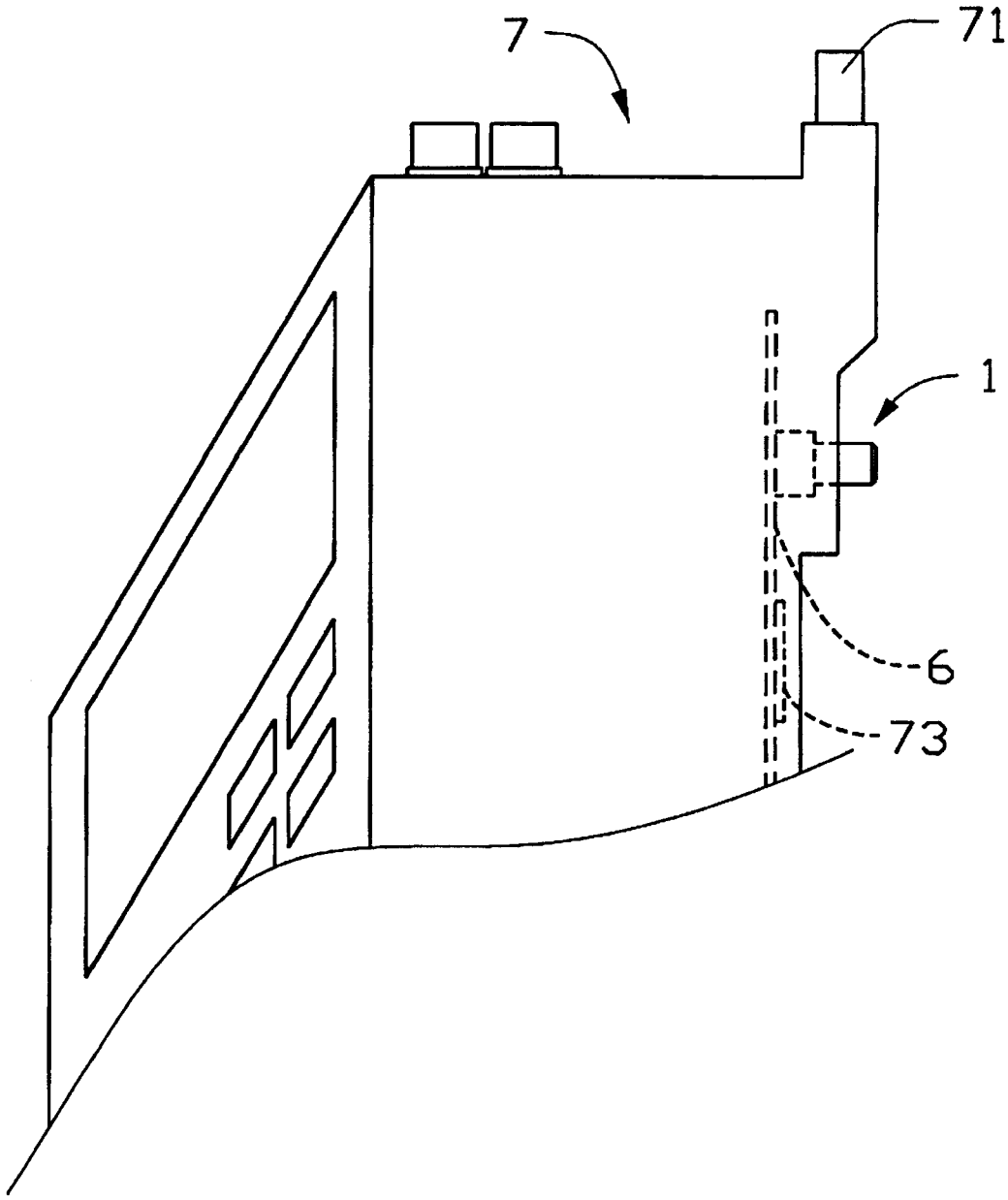
FIG. 3 is a diagrammatic view showing the electrical connector in accordance with the present invention mounted in a cellular phone.

Referring to FIGS. 1 to 3, an electrical connector 1 in accordance with the present invention includes a housing 2 having a rectangular base portion 21 and a cylindrical upper portion 23 upwardly projecting from a middle of the base portion 21. The base portion 21 defines a first contact receiving chamber 211 and a second contact receiving chamber 212 communicating with each other via a passage 213. The upper portion 23 defines a central hole 231 therethrough communicating with the first chamber 211 of the base portion 21. The base portion 21 forms a bottom face 27 for proximity to a printed circuit board 6 on which the connector 1 is mounted. The printed circuit board 6 is received in a portable telecommunication device 7 which is a cellular phone in the preferred embodiment.

The first chamber 211 has a stepped lower surface with an outer lower step 214 and an inner upper step 215. The second chamber 212 has a rectangular configuration. The first chamber 211 is exposed to a right side 216 of the base portion 21, and the second chamber 212 is exposed to a left side 217 thereof. A first conductive contact 4 is fixedly received in the first chamber 211 and has a first horizontal section 42 extending just below the central hole 231 of the upper portion 23, and a second inclined section 44 extending from an outer end (not labeled) of the first section 42 toward the inner upper step 215 to connect with a third horizontal section 46 extending along the outer lower step 214 and interferentially engaging with the base portion 21 of the housing 2. A fourth horizontal section 48 extends from the third section 46 along the bottom face 27 of the base portion 21 toward the right side 216. The fourth horizontal section 48 is used for being soldered to a path on the printed circuit board 6 in electrical connection with speaker/receiver circuitry 73 of the phone 7.

A second conductive contact 5 having a substantially U-shaped configuration is fixedly received in the second chamber 212. The second contact 5 has an upper leg 53 extending through the passage 213 into an upper portion of the first chamber 211, a lower leg 52 extending along the bottom face 27 of the base portion 21 for being soldered to a path on the printed circuit board 6 in electrical connection with a built-in antenna 71, and a body 51 interferentially engaging with the base portion 21.

A metallic shielding 3 is configured to enclose a perimeter of the upper portion 23, and front and rear faces (not labeled) of the base portion 21. The shielding 3 further forms two grounding tabs 31 (only one shown) extending beyond the bottom face 27 of the base portion 21 for being soldered to a grounding path (not shown) of the PCB 6.

When the connector 1 does not connect with a mating coaxial connector in electrical connection with an external antenna, the first horizontal section 42 of the first contact 4 is biased by a spring force of the first contact 4 generated by the inclined section 44 to engage with the upper leg 53 of the second contact 5 whereby signals are bi-directionally transmitted between the speaker/receiver circuitry 73 and the built-in antenna 71 via the first and second contacts 4, 5. In this mode, the phone 7 communicates via the built-in antenna 71. When a coaxial connector (not shown) connecting with an external antenna (not shown) connects with the connector 1 by extending a conductive pin 40 of the coaxial connector through the hole 231 into the first chamber 211, the conductive pin 40 pushes the first horizontal section 42 of the first contact 4 away from the upper leg 53 of the second contact 5 and engages with the first horizontal section 42 of the contact 4, whereby signals are bi-directionally transmitted between the speaker/receiver circuitry 73 and the external antenna via the first contact 4 and the conductive pin 40. In this mode, the phone 7 no longer communicates via the built-in antenna 71.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector for connecting a telecommunication device with a built-in antenna to an external antenna, comprising:

a housing having a base portion defining a first chamber and a second chamber communicating with the first chamber via a passage, a bottom face for being in proximity to a printed circuit board of the device and a top face opposite the bottom face, and a cylindrical portion projecting upwardly from the top face of the base portion and defining a hole therethrough communicating with the first chamber;

a first contact fixedly received in the first chamber, having a contact section shaped with a folded profile and resiliently positioned below the hole of the cylindrical portion and a tail section along the bottom face of the base portion for electrically connecting with speaker/receiver circuitry on the printed circuit board of the device; and a second contact fixedly received in the second chamber, having a contact section extending through the passage into the first chamber and a tail section on the bottom of the base portion for electrically connecting with a built-in antenna of the device;

the contact section of the first contact engaging with the contact section of the second contact when the connector is not connected with a mating connector in electrical connection with an external antenna, and disengaging therefrom when the connector is connected with a mating connector in electrical connection with an external antenna by extending a conductive pin of the mating connector through the hole of the cylindrical portion into the first chamber to engage with the contact section of the first contact.

2. The connector in accordance with claim 1, wherein the contact section of the first contact engages with the contact section of the second contact by a spring force generated from the first contact.

3. The connector in accordance with claim 2, wherein the first contact further comprises a second section extending from the contact portion thereof to a fitting portion interferentially engaging with the housing, said second section providing the spring force.

4. The connector in accordance with claim 3, wherein the first chamber has a stepped lower surface with an outer lower step and an inner upper step, and wherein the second section of the first contact extends from the contact portion thereof toward the inner upper step, and the fitting portion extends along the outer lower step.

5. The connector in accordance with claim 1, wherein the second contact has a U-shaped configuration with a first leg functioning as the contact portion, a second leg functioning as the tail portion, and a body portion between the legs interferentially engaging with the housing.

6. The connector in accordance with claim 1 further comprising a metallic shielding enclosing the connector and having a grounding tab extending beyond the bottom face of the base portion of the housing.

7. The connector in accordance with claim 1, wherein the base portion has a rectangular shape, said first chamber being exposed to a first lateral side of the base portion and said second chamber being exposed to a second lateral side thereof.

8. The connector in accordance with claim 7 further comprising a metallic shielding enclosing the cylindrical portion and front and rear faces of the base portion of the housing, and having a grounding tab extending beyond the bottom face of the base portion of the housing.

9. An arrangement for shifting from an internal antenna to an external antenna, comprising:

an electrical connector including a housing receiving a first contact and a second contact therein, said housing defining a cylindrical portion projecting upwardly from a top face of a rectangular base portion of the housing and forming a hole therethrough;

said first contact including a contact section shaped with a folded profile, and resiliently positioned below the hole of the cylindrical portion and a tail section connecting to speaker/receiver circuitry on a printed circuit board of a device;

said second contact including a contact section for engaging with the contact section of the first contact, and a tail section connecting to a built-in antenna of said device; wherein when the external antenna is not applied thereto, the contact section of the first contact is mechanically and electrically connected to the contact section of the second contact so as to have the device operated by the internal antenna; in opposite, when the external antenna is applied thereto, the contact section of the first contact is mechanically and electrically disengaged from the contact section of the second contact by a conductive pin connected to the external antenna so as to have the device operated by the external antenna.

* * * * *